US005300005A

United States Patent [19]

Wang

[11] Patent Number: 5,300,005

[45] Date of Patent: Apr. 5, 1994

[54] STRUCTURE OF ABDOMEN EXERCISER

[75] Inventor: Leao Wang, Taichung Hsien, Taiwan

[73] Assignee: Greenmaster Industrial Corporation, Taichung Hsien, Taiwan

[21] Appl. No.: 22,458

[22] Filed: Feb. 25, 1993

[51] Int. Cl.[5] ..... A63B 21/00

[52] U.S. Cl. ..... 482/142; 482/97

[58] Field of Search ..... 482/140–342, 482/49, 72, 92, 93, 97, 98, 121–123, 125, 130, 133–136, 138, 148

[56] References Cited

U.S. PATENT DOCUMENTS

| | | | |
|---|---|---|---|
| 4,240,626 | 12/1980 | Lambert, Jr. | 482/100 |
| 4,500,089 | 2/1985 | Jones | 482/100 |
| 4,609,190 | 9/1986 | Brentham | 482/142 |
| 4,834,396 | 5/1989 | Schell | 482/97 |
| 5,060,939 | 10/1991 | Oswald et al. | 482/142 |
| 5,066,003 | 11/1991 | Jones | 482/142 |
| 5,070,863 | 12/1991 | McArthur et al. | 482/142 |
| 5,110,121 | 5/1992 | Foster | 482/142 |
| 5,180,354 | 1/1993 | Jones | 482/142 |
| 5,215,511 | 6/1993 | Cheng | 482/142 |

FOREIGN PATENT DOCUMENTS

| | | | |
|---|---|---|---|
| 2232089 | 12/1990 | United Kingdom | 482/97 |

*Primary Examiner*—Richard J. Apley
*Assistant Examiner*—Jerome Donnelly
*Attorney, Agent, or Firm*—Bacon & Thomas

[57] ABSTRACT

An abdomen exerciser includes two three-end links respectively pivoted to two curved supports on a base frame at opposite sides to hold two leg presses, two sets of weights, and a back cushion. The sets of weights automatically turn the three-end links on the curved supports in lifting the back cushion from a horizontal position to a vertical position as the player bends the trunk upwards, or give a pressure to the player's back as the player lies down. Either leg press can be turned into the operative position for hanging the respective leg in raising the player's center of gravity.

2 Claims, 6 Drawing Sheets

STRUCTURE OF ABDOMEN EXERCISER

BACKGROUND OF THE INVENTION

The present invention relates to an abdomen exerciser for training the muscles of the abdomen.

A variety of abdomen exercising apparatus have been disposed, and have appeared on the market. FIG. 1 illustrates an abdomen exercising apparatus which was filed by the present inventor on Dec. 8, 1992 under filing No. 07/992,730. This structure of abdomen exercising apparatus is suitable for people of different ages and physical conditions. However, it is simply designed for trunk bending upwards, and it gives little damping resistance as the trunk is lying down.

SUMMARY OF THE INVENTION

According to one aspect of the present invention, the abdomen exerciser comprises two three-end links respectively pivoted to two curved supports on a mainframe at opposite sides to hold two leg presses, two sets of weights, and a back cushion. The sets of weights automatically turn the three-end links on the curved supports in lifting the back cushion from a horizontal position to a vertical position as the player bends the trunk upwards, or give a pressure to the player's back as the player lies down.

According to another aspect of the present invention, either leg press can be turned into the operative position for hanging the respective leg in raising the player's center of gravity, or the non-operative position for permitting the respective leg to be hung on pairs of cross bars on a front frame of the mainframe.

According to still another aspect of the present invention, two handlebars are respectively made on the three-end links for holding with the hands during exercising.

According to still another aspect of the present invention, the mainframe can be alternatively arranged to hold the seat cushion a sloping position or a horizontal position.

DETAILED DESCRIPTION OF THE PREFERRED EMBODIMENT

Figure 1:
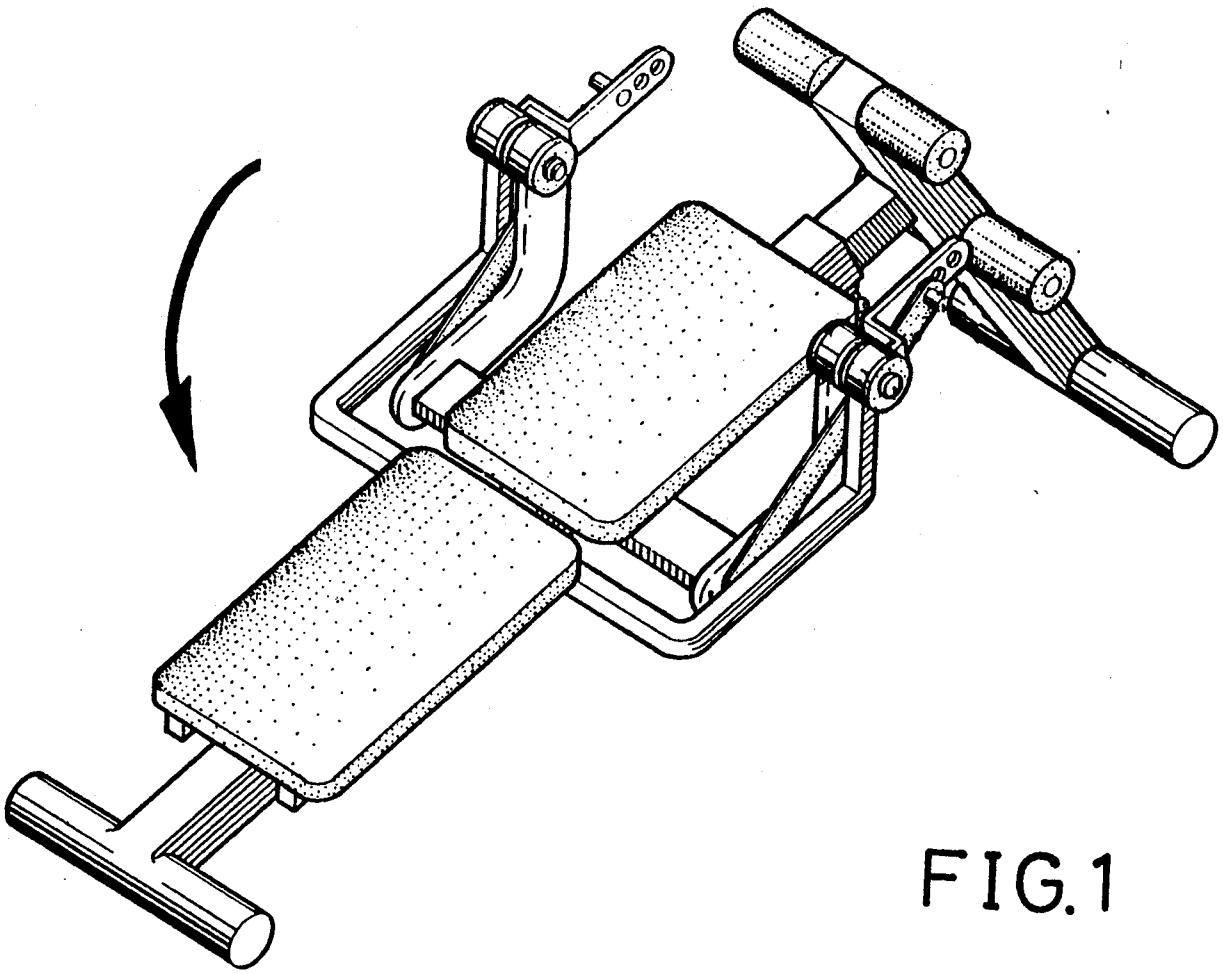
FIG. 1 is an abdomen exercising apparatus according to U.S. patent application Ser. No. 07/992,730.
Figure 2:
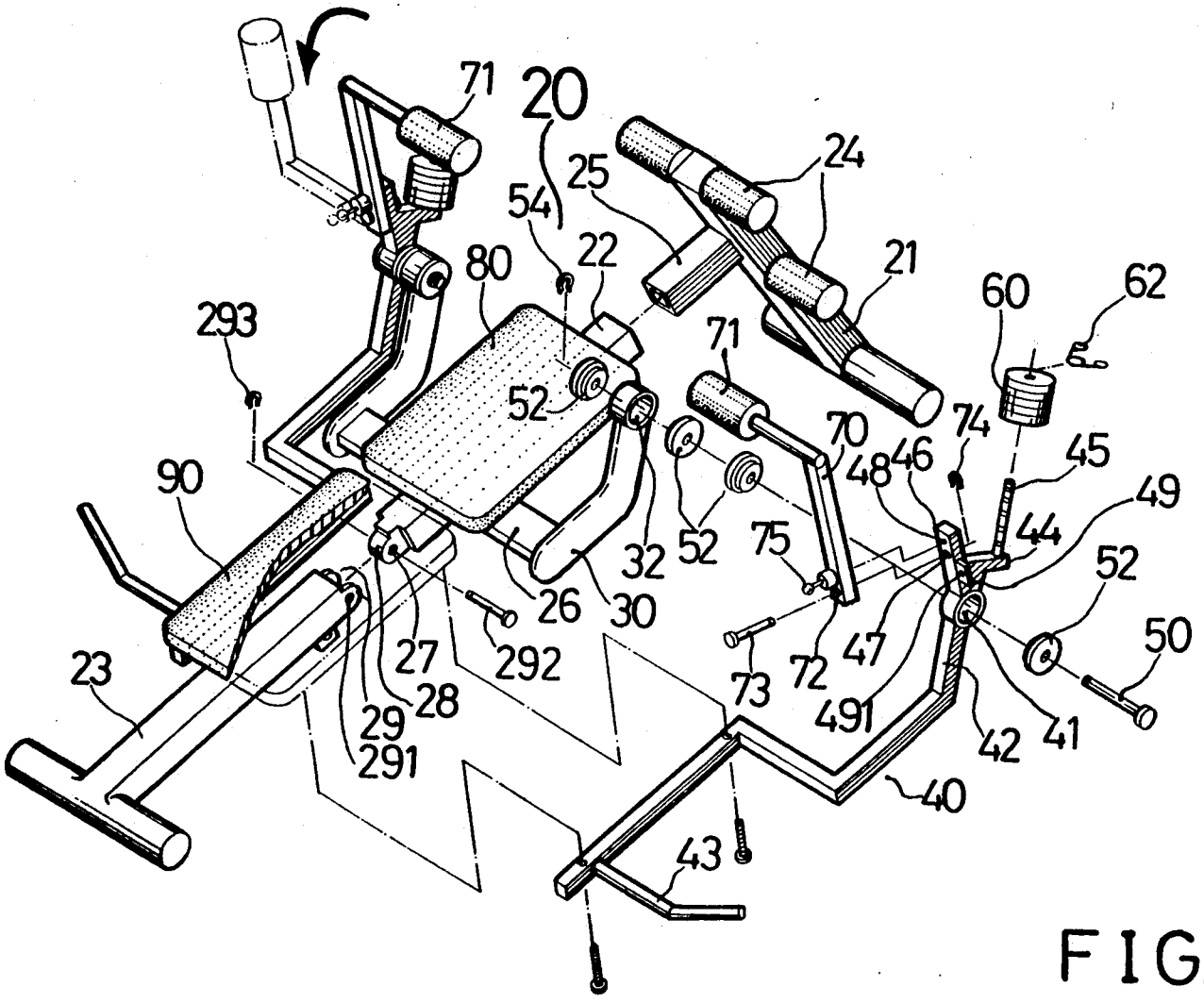
FIG. 2 is an exploded view of an abdomen exerciser according to the present invention.
Figure 3:
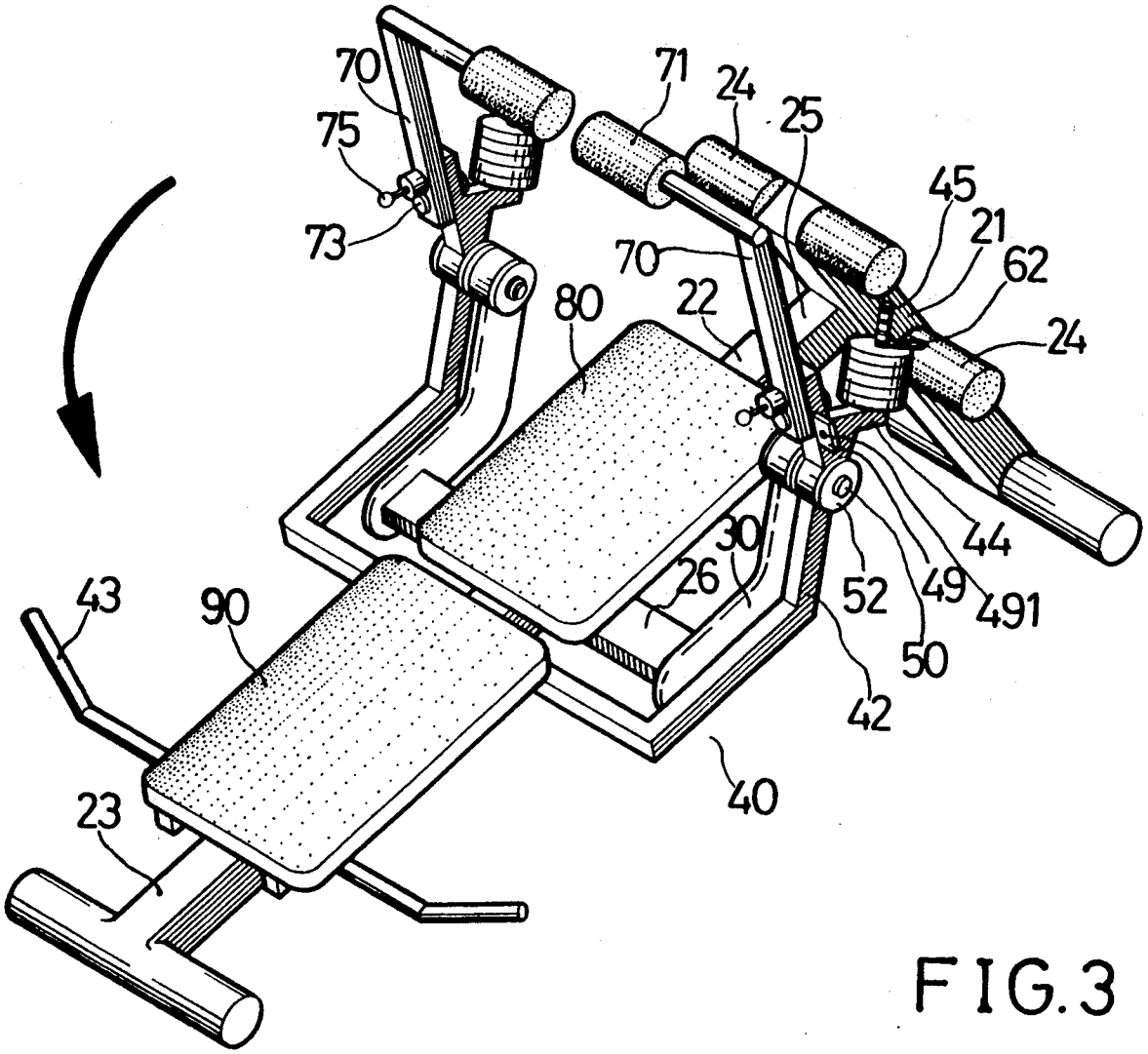
FIG. 3 is a perspective elevation of the abdomen exerciser of FIG. 2.

Referring to FIGS. 2 and 3, therein illustrated is an abdomen exerciser embodying the present invention, which is generally comprised of a mainframe 20, two curved supports 30, two three-end links 40, pivot axles 50, two equal sets of weights 60, two leg presses 70, a seat cushion 80, and a back cushion 90.

The mainframe 20 comprises a front frame 21 and a rear frame 23 joined by an intermediate frame 22. The front frame 21 comprises pairs of cross bars 24 spaced from the top, which may be respectively covered with a soft covering for resting the legs comfortably, and a rear extension bar 25 perpendicularly extended towards the back. The intermediate frame 22 is made from a hollow bar having a transverse bar 26 intersected in the middle, and a semi-circular mounting block 28 with a transverse through hole 27 at the rear end thereof. Because the intermediate frame 22 is made from a hollow bar, the front frame 21 can be conveniently connected to the intermediate frame 22 by inserting the rear extension bar 25 into the axial hole (not shown) on the intermediate frame 22. The rear frame 23 comprises two parallel lugs 29 with through holes 291 at the front end thereof, which receive the semi-circular mounting block 28 of the intermediate frame 22. Therefore, the rear frame 23 can be conveniently and pivotally connected to the intermediate frame 22 by a pin 292 and a clamping retainer 293.

The two curved supports 30 have each one end respectively welded to either end of the transverse bar 26 and an opposite end obliquely curved forwards and upwards and terminated to a respective transverse bushing 32.

The two three-end links 40 respectively fit over the transverse bar 26 and the curved supports 30, having each a transverse bushing 41 at the connecting area of the three ends thereof respectively connected to the transverse bushing 32 on either curved support 30 by a pivot axle 50, a plurality of washers 52 and a clamping retainer 54 respectively. The first terminal, namely, the curved, longest terminal 42 of each three-end link 40 is fastened to the back cushion 90 at the bottom and attached with a respective handlebar 43. The second terminal 44 of each three-end link 40 terminates to a projecting rod 45, on which a respective set of weights 60 is mounted and retained by a respective spring clamp 62. The third terminal 46 of each three-end link 40 comprises a through hole 47, to which either leg press 70 is pivotally connected, a pin hole 48, and a side projection 49 with a pin hole 491.

The two leg presses 70 are respectively made in the shape of an angle bar, having each one end coupled with a soft covering 71 disposed in the horizontal position and an opposite end disposed in the vertical position and made with a through hole 72 connected to the through hole 47 on the third terminal 46 of the respective three-end link 40 by a pin 73 and clamping retainer 74. Each leg press 70 further comprises a spring-controlled lock bolt 75 alternatively locked in the pin hole 48 on the third terminal 46 or the pin hole 491 on the side projection 49. As the lock bolt 75 is locked in the pin hole 48 on the third terminal 46, the soft covering 71 of the respective leg press 70 becomes disposed above the seat cushion 80 for hanging the back of the knee. As the lock bolt 75 is locked in the pin hole 491 on the side projection 49, the soft covering 71 of the respective leg press 70 becomes turned sideways for permitting the respective leg to be hung on the pairs of cross bars 24 on the front frame 21. Therefore, each leg press 70 may be fastened to the respective three-end link 40 at either position.

The seat cushion 80 is mounted on the intermediate frame 22 at the top. The back cushion 90 is mounted on the three-end links 40 at the first terminals 42 thereof and longitudinally disposed in line with the seat cushion 80 before mounting the sets of weights 60 on the projecting rod 45 of the second terminal 44 of either three-end link 40.

Figure 4:
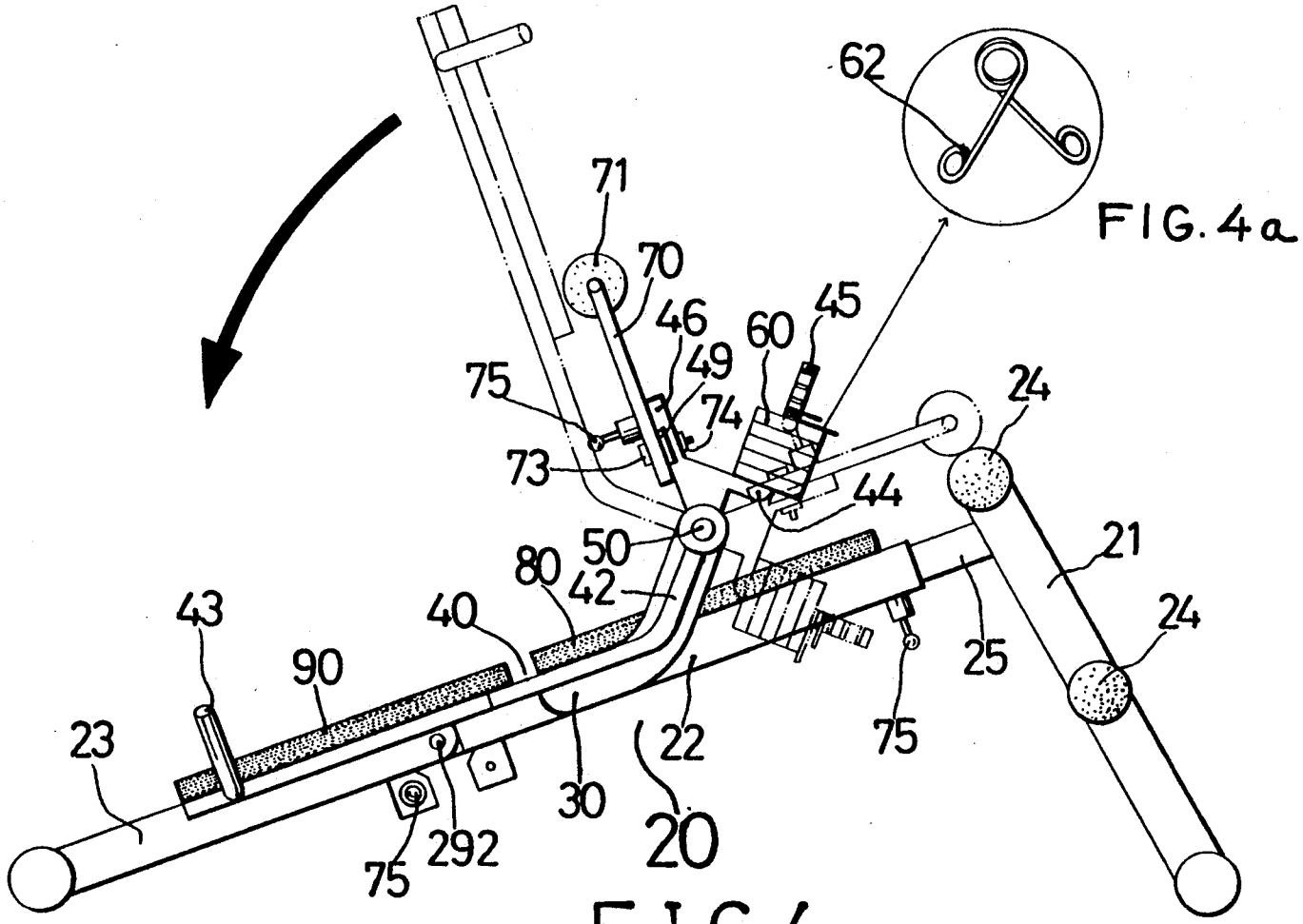
FIG. 4 is a side plan of the abdomen exerciser of FIG. 2 showing the back cushion moved from a vertical position to a horizontal position.
Figure 5:
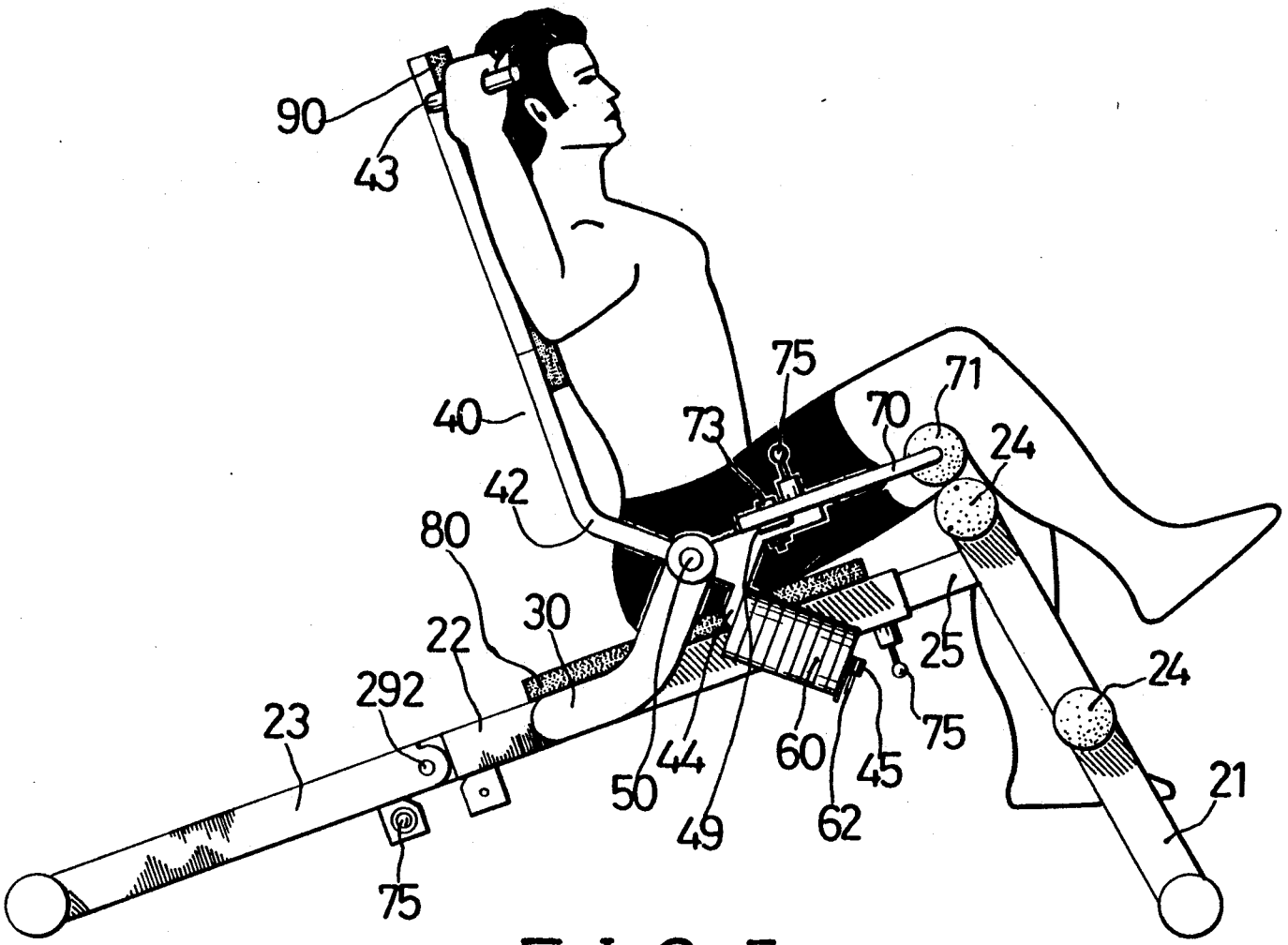
FIG. 5 is an operated view of the abdomen exerciser of FIG. 2 showing one leg hung on the respective leg press and the other leg hung on the front frame.

Referring to FIGS. 4 and 5, after the two sets of weights 60 have been respectively mounted on the projecting rod 45 of the second terminal 44 of either three-end link 40, the first terminal 42 of each three-end link 40 is turned upwards to lift the back cushion 90 from the horizontal position to the vertical position. When in use, the player sits on the seat cushion 80 with the back of the knee hung on the pairs of cross bars 24 on the front frame 21, as the covering 71 of each leg press 70 has been turned sideways, and with the hand held on the handlebar 43 on either three-end link 40. As the player lies down to overcome the gravity of the sets of weights 60, the back cushion 90 is gradually lowered from the vertical position to the horizontal position. As the player bends the trunk upwards, the gravity of the sets of weights 60 forces the three-end links 40 to lift the the back cushion 90 in helping the player bend the trunk upwards. The soft covering 71 of either leg press 70 may be turned inwards and disposed above the seat cushion 80 for hanging the back of knee of the respective leg while the other leg is maintained hanging on the pairs of cross bars 24 on the front frame 21. Under this mode, the player's center of gravity is relatively raised (from the hip) for exercising backward pressing exercises.

The projecting rod 45 on the second terminal 44 of either three-end link 40 must be made at a suitable angular position relative to the intermediate frame 22 so that the contained angle between the intermediate frame 22 and the projecting rod 45 is not a right angle as the back cushion 90 is disposed in either the horizontal or the vertical position.

Figure 6:
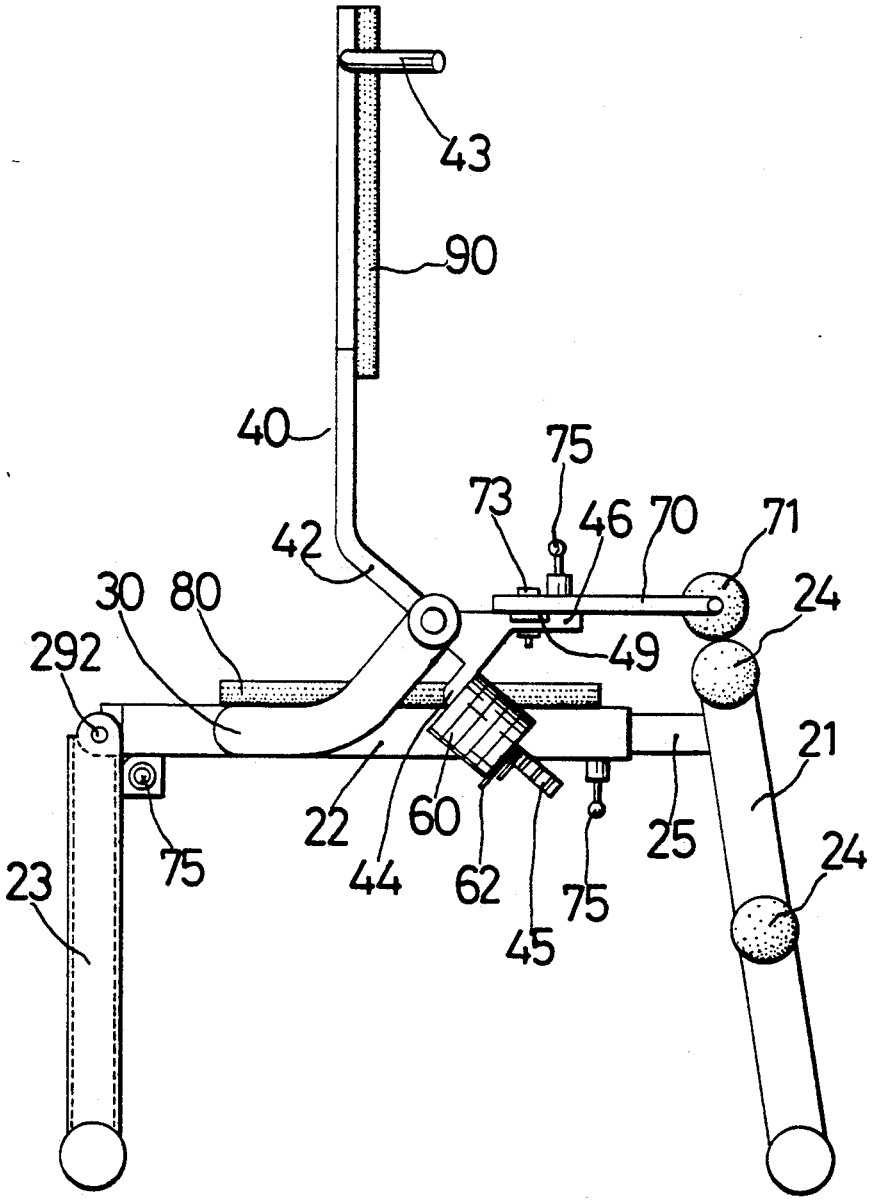
FIG. 6 is another side plan of the abdomen exerciser of FIG. 2 when the rear end locked in a perpendicular position to support the intermediate frame in horizontal.

Referring to FIG. 6, the rear frame 23 may be turned downwards on the semi-circular mounting block 28 and locked in a perpendicular position relative to the intermediate frame 22 by another spring-controlled lock bolt 75, for permitting the intermediate frame 22 (namely, the seat cushion 80) to be retained in horizontal.

What is claimed is:

1. An abdomen exerciser comprising: a front frame and a rear frame joined by an intermediate frame, a seat cushion mounted on said intermediate frame at the top, two curved supports bilaterally welded to a transverse bar on said intermediate frame, two three-end links respectively pivoted to said curved supports to hold a back cushion in a first position longitudinally disposed in line with said seat cushion or a second position perpendicularly disposed above said seat cushion, and two sets of weights symmetrically mounted on said three-end links to automatically turned said back cushion to said second position, wherein:

said intermediate frame has hollow front end, which receives a rear extension rod on said front frame, and a rear end terminated to a semi-circular mounting block pivotally fastened to two parallel lugs on said rear frame by a pin and a clamping retainer;

each three-end link comprises a first terminal fitted over the transverse bar on said intermediate frame and either curved support to hold said back cushion, a bushing on one end of said first terminal pivotally connected to a bushing on either curved support by a pin and a set of washers and a clamping retainer and disposed at an elevation above said seat cushion, a handlebar on an opposite end of said first terminal, a second terminal having one end connected to the bushing on said first terminal and an opposite end terminated to a projecting rod to hold either set of weights by a respective spring clamp, and a third terminal having a through hole, to which either leg press is pivotally connected, a pin hole, and a side projection with a pin hole;

each leg press is respectively made in the shape of an angle bar, having a free end coupled with a soft covering disposed in horizontal, a fixed end pivotally connected to the through hole on the third terminal of either three-end link by a pin and a clamping retainer, and a spring-controlled lock bolt alternatively locked in the pin hole on the third terminal of either three-end link or the pin hole on the side projection for permitting the soft covering of the respective leg press to be disposed in horizontal above said seat cushion or turned sideways.

2. The abdomen exerciser of claim 1 wherein the contained angle between the projecting rod on the second terminal of either three-end link and said intermediate frame should be not equal to 90° angle as said back cushion is disposed in either the first or the second position.

* * * * *